US010916847B2

(12) United States Patent
Chang

(10) Patent No.: US 10,916,847 B2
(45) Date of Patent: Feb. 9, 2021

(54) MULTI-BAND ANTENNA

(71) Applicant: Acer Incorporated, New Taipei (TW)

(72) Inventor: Kun-Sheng Chang, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/396,743

(22) Filed: Apr. 28, 2019

(65) Prior Publication Data

US 2020/0168991 A1 May 28, 2020

(30) Foreign Application Priority Data

Nov. 23, 2018 (TW) ..... 107141762 A

(51) Int. Cl.
*H01Q 5/50* (2015.01)
*H01Q 5/328* (2015.01)
*H01Q 1/36* (2006.01)

(52) U.S. Cl.
CPC ..... *H01Q 5/328* (2015.01); *H01Q 1/36* (2013.01); *H01Q 5/50* (2015.01)

(58) Field of Classification Search
CPC .. H01Q 5/00; H01Q 5/10; H01Q 5/50; H01Q 5/328; H01Q 5/378; H01Q 5/371; H01Q 5/357; H01Q 1/48; H01Q 1/50; H01Q 1/243; H01Q 9/045; H01Q 9/0442; H01Q 9/0435; H01Q 9/0421
See application file for complete search history.

(56) References Cited

U.S. PATENT DOCUMENTS 4,730,195 A * 3/1988 Phillips ..... H01Q 9/18 343/727
6,903,686 B2 * 6/2005 Vance ..... H01Q 1/243 343/700 MS
7,525,488 B2 * 4/2009 Rowell ..... H01Q 1/243 343/700 MS
7,592,957 B2 * 9/2009 Achour ..... H01Q 1/38 343/700 MS
7,605,766 B2 * 10/2009 Dahlstrom ..... H01Q 1/243 343/700 MS (Continued)

FOREIGN PATENT DOCUMENTS

CN 202564541 11/2012
TW 201008025 2/2010

(Continued)

*Primary Examiner* — Haissa Philogene
(74) *Attorney, Agent, or Firm* — JCIPRNET

(57) ABSTRACT

A multi-band antenna includes a ground plane and an antenna element. The antenna element includes a first radiation portion and a second radiation portion. A first end of the first radiation portion is coupled to a feeding point, and a second end of the first radiation portion is a first open end. A first end of the second radiation portion is coupled to a ground plane, and a second end of the second radiation portion is a second open end. The second radiation portion is not electrically connected to the first radiation portion, and a coupling distance exists between the second radiation portion and the first radiation portion. The antenna element operates in a first band through the first radiation portion and operates in a second band through the second radiation portion. The frequency in the first band is lower than the frequency in the second band.

11 Claims, 3 Drawing Sheets

(56) References Cited

U.S. PATENT DOCUMENTS

| | | | | |
|---|---|---|---|---|
| 8,456,365 | B2 * | 6/2013 | Pros | H01Q 1/243 343/700 MS |
| 8,618,990 | B2 * | 12/2013 | Somero | H01Q 1/48 343/702 |
| 8,836,582 | B2 * | 9/2014 | Wong | H01Q 1/38 343/700 MS |
| 9,246,223 | B2 * | 1/2016 | Badaruzzaman | H03H 7/40 |
| 9,484,619 | B2 * | 11/2016 | Korva | H01Q 1/243 |
| 9,531,058 | B2 * | 12/2016 | Isohatala | H01Q 1/243 |
| 9,917,346 | B2 * | 3/2018 | Ramachandran | H01Q 1/24 |
| 10,135,141 | B2 * | 11/2018 | Huang | H01Q 9/42 |
| 2007/0069958 | A1 | 3/2007 | Ozkar | |

FOREIGN PATENT DOCUMENTS

| | | |
|---|---|---|
| TW | M404501 | 5/2011 |
| TW | 201324942 | 6/2013 |

* cited by examiner

MULTI-BAND ANTENNA

CROSS-REFERENCE TO RELATED APPLICATION

This application claims the priority benefit of Taiwan application serial no. 107141762, filed on Nov. 23, 2018. The entirety of the above-mentioned patent application is hereby incorporated by reference herein and made a part of this specification.

BACKGROUND OF THE DISCLOSURE

Field of the Disclosure

The disclosure relates to a multi-band antenna, and more particularly relates to a multi-band antenna operable in a plurality of bands.

Description of Related Art

In recent years, in order to satisfy consumers' demands for image quality and product appearance, the product design of communication devices is gradually moving towards a narrow frame development trend. However, in the design of the narrow frame, there are fewer and fewer areas in the communication device where the antenna elements can be arranged. In addition, as more and more image-capturing components (such as camera lenses, flashlights) are added to the top edge of the communication device, the area for antenna arrangement available in the communication device is greatly limited.

Therefore, it is important for practitioners of the field of antenna design to find out how to properly arrange the antenna elements in a limited layout area without affecting the communication quality.

SUMMARY OF THE DISCLOSURE

The disclosure provides a multi-band antenna capable of configuring antenna elements in a limited antenna layout area and maximizing the operating band range of the antenna elements.

Embodiments of the disclosure provide a multi-band antenna. The multi-band antenna includes a ground plane and an antenna element. The antenna element includes a first radiation portion and a second radiation portion. A first end of the first radiation portion is coupled to a feeding point, and a second end of the first radiation portion is a first open end. A first end of the second radiation portion is coupled to the ground plane, and a second end of the second radiation portion is a second open end. The second radiation portion is not electrically connected to the first radiation portion, and a coupling distance exists between the second radiation portion and the first radiation portion. The antenna element operates in the first band through the first radiation portion and operates in the second band through the second radiation portion, and the frequency of the first band is lower than the frequency of the second band.

Based on the above, in the embodiments of the disclosure, the antenna element of the multi-band antenna includes a first radiation portion and a second radiation portion that are not electrically connected to each other, and the coupling distance exists between the second radiation portion and the first radiation portion. By maintaining the electrical floating state between the first radiation portion and the second radiation portion, it is possible to avoid a serious interference situation in the first band and the second band of the antenna element. Since there is no need to take the band interference into consideration, the coupling distance between the first radiation portion and the second radiation portion can be shortened as much as possible to save the antenna layout area. Therefore, the first radiation portion and the second radiation portion of the preset size can be configured in a limited antenna layout area within the communication device, so that the operating band range of the antenna element can be maximized, thereby improving the performance of the antenna element.

In order to make the aforementioned features and advantages of the disclosure more comprehensible, embodiments accompanying figures are described in detail below.

DESCRIPTION OF EMBODIMENTS

Figure 1:
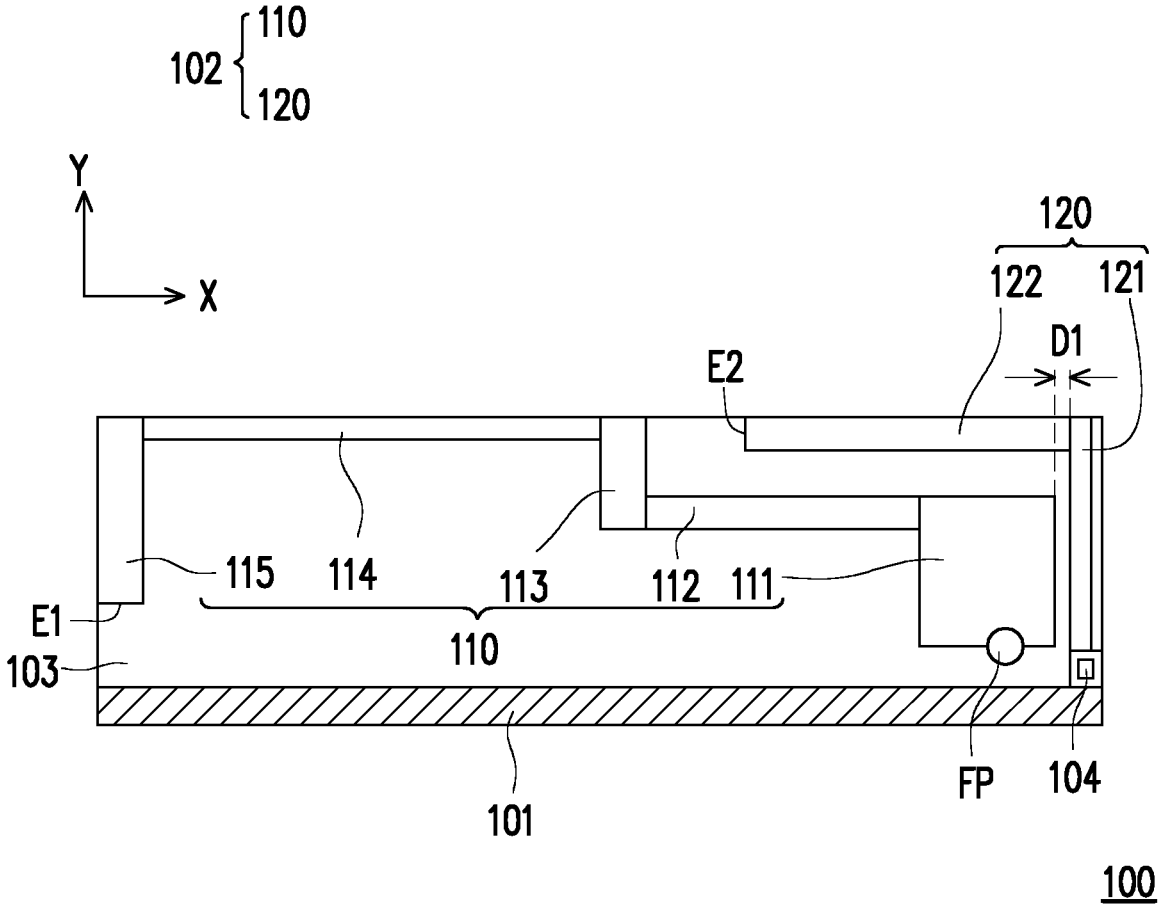
FIG. 1 is a schematic top view of a multi-band antenna according to an embodiment of the disclosure.

The term "coupled (or connected)" as used throughout the specification (including the claims) may refer to any direct or indirect connection means. For example, if the first device is described as being coupled (or connected) to the second device, it should be construed that the first device can be directly connected to the second device, or the first device can be indirectly connected to the second device through other devices or a certain connection means. In addition, wherever possible, the elements/components/steps denoted by the same reference numeral in the drawings and embodiments represent the same or similar parts. The elements/components/steps denoted by the same reference numeral or described in the same manner in different embodiments may be cross-reference for each other.

FIG. 1 is a schematic top view of a multi-band antenna 100 according to an embodiment of the disclosure. Referring to FIG. 1, the multi-band antenna 100 includes a ground plane 101 and an antenna element 102. According to the requirement of design, the multi-band antenna 100 may be applied to a notebook computer, a Bluetooth communication device, a smart phone, a tablet computer or other wireless transceiver device. Further, the multi-band antenna 100 further has a substrate 103. The substrate 103 can be used to carry the antenna element 102 and serve as an antenna layout area. The antenna element 102 may be a planar antenna, and the substrate 103 may be an FR-4 substrate (Flame Retardant-4 Substrate) or other dielectric substrate.

The antenna element 102 may include a first radiation portion 110 and a second radiation portion 120. A first end of the first radiation portion 110 is coupled to a feeding point FP, and a second end of the first radiation portion 110 is an open end E1. A first end of the second radiation portion 120 is coupled to a ground plane 101, and a second end of the second radiation portion 120 is an open end E2. The second radiation portion 120 is not electrically connected to the first radiation portion 110, and a coupling distance D1 exists between the second radiation portion 120 and the first radiation portion 110.

In operation, the antenna element 102 may receive a feed signal provided by a transceiver (not shown) of the multi-band antenna 100 through the feeding point FP. For example, the feeding point FP disposed on the first radiation portion 110 may be electrically connected to the transceiver of the multi-band antenna 100 through a coaxial cable, a conductive elastic piece or a pogo pin, so that the first radiation portion 110 can receive the feed signal from the transceiver, thereby generating a first resonant mode. At the same time, the feed signal can also be coupled from the feeding point FP of the first radiation portion 110 to the second radiation portion 120 through the coupling distance D1 between the first radiation portion 110 and the second radiation portion 120, so that the second radiation portion 120 produces a second resonant mode. The first resonant mode and the second resonant mode may correspond to the first band and the second band, respectively. Therefore, the antenna element 102 may be operated in the first band through the first radiation portion 110 and operated in the second band through the second radiation portion 120.

In this embodiment, the first end of the second radiation portion 120 may be coupled to the ground plane 101 through a matching component 104 to adjust impedance matching of the antenna element 102 in the second band and shorten a resonance path formed by the second radiation portion 120. In addition, since the second radiation portion 120 and the first radiation portion 110 are not electrically connected, but are maintained in an electrical floating state, the degree of interference between the first resonant mode and the second resonant mode may be minimized.

Further referring to FIG. 1, the first radiation portion 110 sequentially includes a first segment 111, a second segment 112, a third segment 113, a fourth segment 114 and a fifth segment 115 that are connected in series from the feeding point FP to the open end E1. A longitudinal direction of the second segment 112 and a longitudinal direction of the fourth segment 114 are both parallel to a first direction (for example, the X direction). A longitudinal direction of the first segment 111, a longitudinal direction of the third segment 113, and a longitudinal direction of the fifth segment 115 are all parallel to a second direction (for example, the Y direction), and the first direction is perpendicular to the second direction. It should be noted that FIG. 1 is an example in which the longitudinal direction of the first segment 111 is parallel to the Y direction. In other embodiments, the longitudinal direction of the first segment 111 may also be parallel to the X direction, that is, a length of the first segment 111 in the X direction may be designed to be larger than the length of the first segment 111 in the Y direction.

As shown in FIG. 1, the second radiation portion 120 includes a sixth segment 121 and a seventh segment 122 which are connected in series with each other. The longitudinal direction of the seventh segment 122 is parallel to the first direction (for example, the X direction), and the longitudinal direction of the sixth segment 121 is parallel to the second direction (for example, the Y direction). In other words, the longitudinal direction of the sixth segment 121 is parallel to the longitudinal direction of the third segment 113, and the longitudinal direction of the seventh segment 122 is parallel to the longitudinal direction of the second segment 112.

Figure 2A:
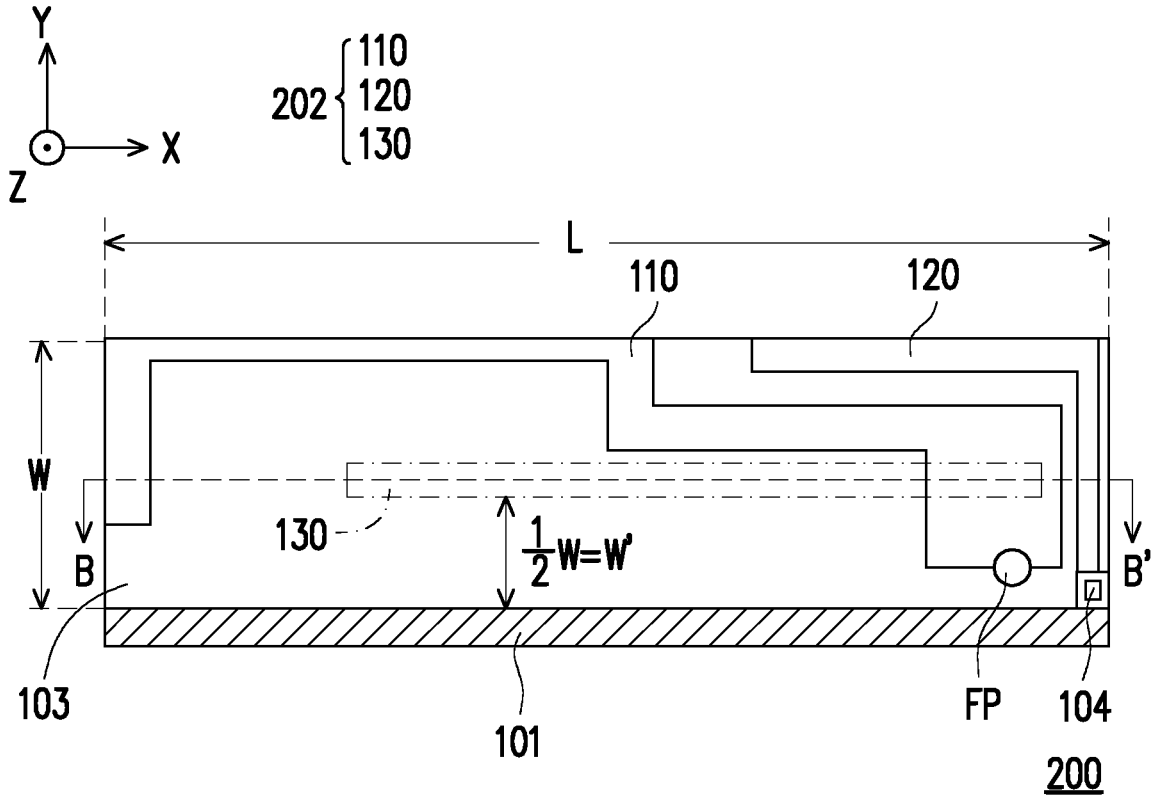
FIG. 2A is a schematic top view of a multi-band antenna according to another embodiment of the disclosure.

FIG. 2A is a schematic top view of a multi-band antenna 200 according to another embodiment of the disclosure. The multi-band antenna 200 includes a ground plane 101, an antenna element 202, and a substrate 103, wherein the substrate 103 may have a first length L (e.g., 65 mm) and a first width W (e.g., 10 mm). The antenna element 202 is operable in the first band through the first radiation portion 110 and operable in the second band through the second radiation portion 120. In this embodiment, the first band may include a band between 704 MHz and 960 MHz, and the second band may include a band between 1710 MHz and 2170 MHz. In other embodiments, the frequency ranges of the first band and the second band may be adjusted according to other design requirements. For example, the operating band of the antenna element 202 may be designed to cover the communication band of the entire Long Term Evolution (LTE) technology.

Figure 2B:
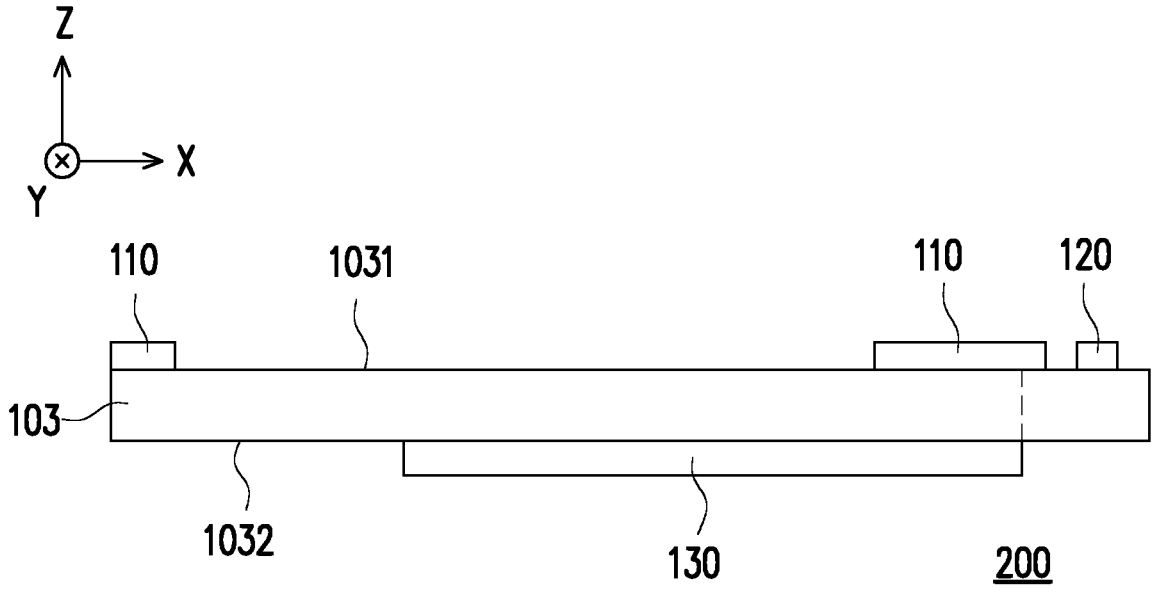
FIG. 2B is a schematic cross-sectional view of the multi-band antenna of FIG. 2 taken along line B-B' according to an embodiment of the disclosure.

Different from the embodiment of FIG. 1, the antenna element 202 of FIG. 2A further includes a third radiation portion 130. The third radiation portion 130 and the first radiation portion 110 are respectively disposed on two opposite surfaces of the substrate 103, and the third radiation portion 130 and the first radiation portion 110 are not electrically connected. For example, FIG. 2B is a schematic cross-sectional view of the multi-band antenna 200 of FIG. 2 taken along line B-B' according to an embodiment of the disclosure. As shown in FIG. 2B, the first radiation portion 110 and the second radiation portion 120 may be disposed on the first surface 1031 of the substrate 103, and the third radiation portion 130 may be disposed on the second surface 1032 of the substrate 103.

The feed signal of the multi-band antenna 200 may be coupled from the feeding point FP of the first radiation portion 110 to the third radiation portion 130, such that the third radiation portion 130 generates a third resonant mode corresponding to a third band. In this embodiment, the antenna element 202 is operable in the third band through the third radiation portion 130, and a frequency of the third band may be higher than the frequency of the second band of the second radiation portion 120. For example, the third band may contain bands ranging between 2.3 GHz and 2.7 GHz. Therefore, the antenna element 202 can be respectively operated in a low-frequency band (first band) and two high-frequency bands (second band and third band) through the first radiation portion 110, the second radiation portion 120, and the third radiation portion 130.

Further, the position of the third radiation portion 130 in the Y direction may be disposed at a position away from the ground plane 101 to enhance the coupling efficiency of the third radiation portion 130 and the first radiation portion 110. For example, as shown in FIG. 2A, the short side of the substrate 103 has a first width W, and a first distance W' exists between the third radiation portion 130 and the ground plane 101. In the embodiment, the first distance W' between the third radiation portion 130 and the ground plane 101 is equal to half (i.e., W'=W/2) of the first width W. In other embodiments, the first distance W' may be greater than or equal to half (i.e., W'>W/2) of the first width W.

Figure 2C:
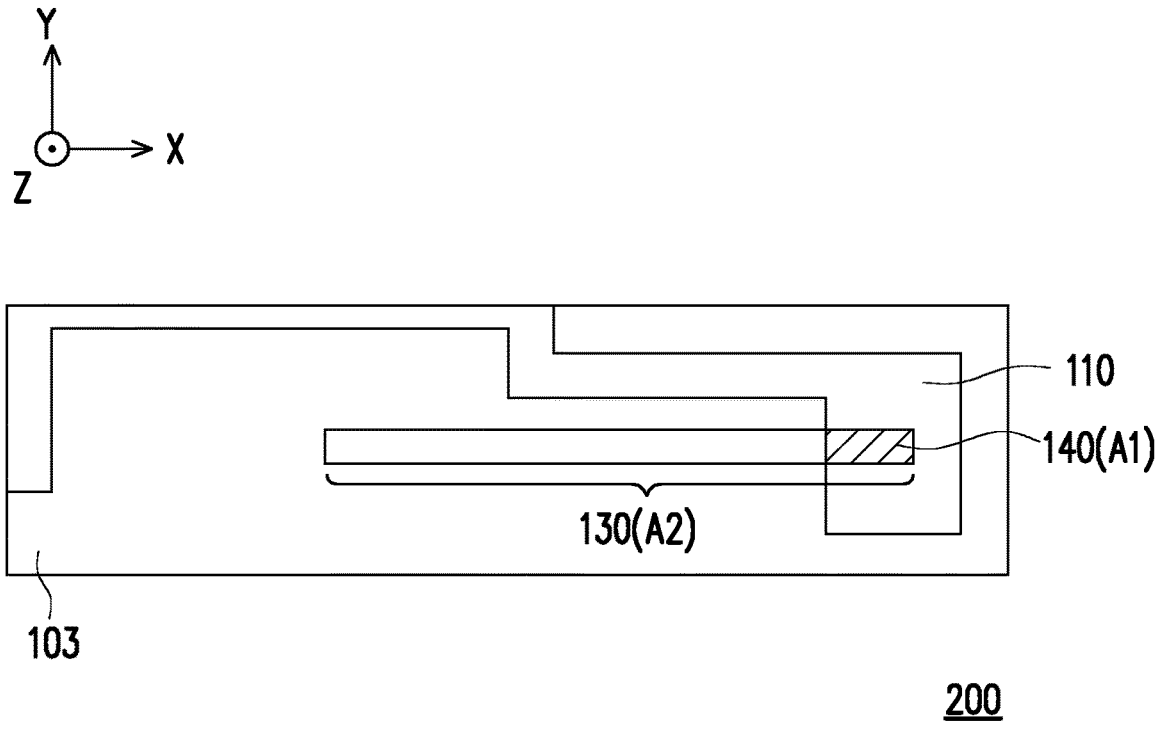
FIG. 2C is a schematic view showing an overlapping region of a first radiation portion and a third radiation portion of FIG. 2 in the Z direction according to an embodiment of the disclosure.

The position of the third radiation portion 130 in the X direction may be set to a position close to the feeding point FP to improve the coupling efficiency of the third radiation portion 130 and the first radiation portion 110. For example, FIG. 2C is a schematic view showing an overlapping region of the first radiation portion 110 and the third radiation portion 130 of FIG. 2 in the Z direction according to an embodiment of the disclosure. As shown in FIG. 2C, an orthogonal projection (the orthogonal projection in the Z direction) of the first radiation portion 110 on the substrate 103 and an orthogonal projection (the orthogonal projection in the Z direction) of the third radiation portion 130 on the substrate 103 may form an overlapping region 140. The overlapping region 140 is located on the right side of the third radiation portion 130, that is, close to the feeding point FP. Further, the overlapping region 140 has a first area A1, and the orthogonal projection of the third radiation portion 130 on the substrate 103 has a second area A2, and the first area A1 is smaller than the second area A2.

Figure 3:
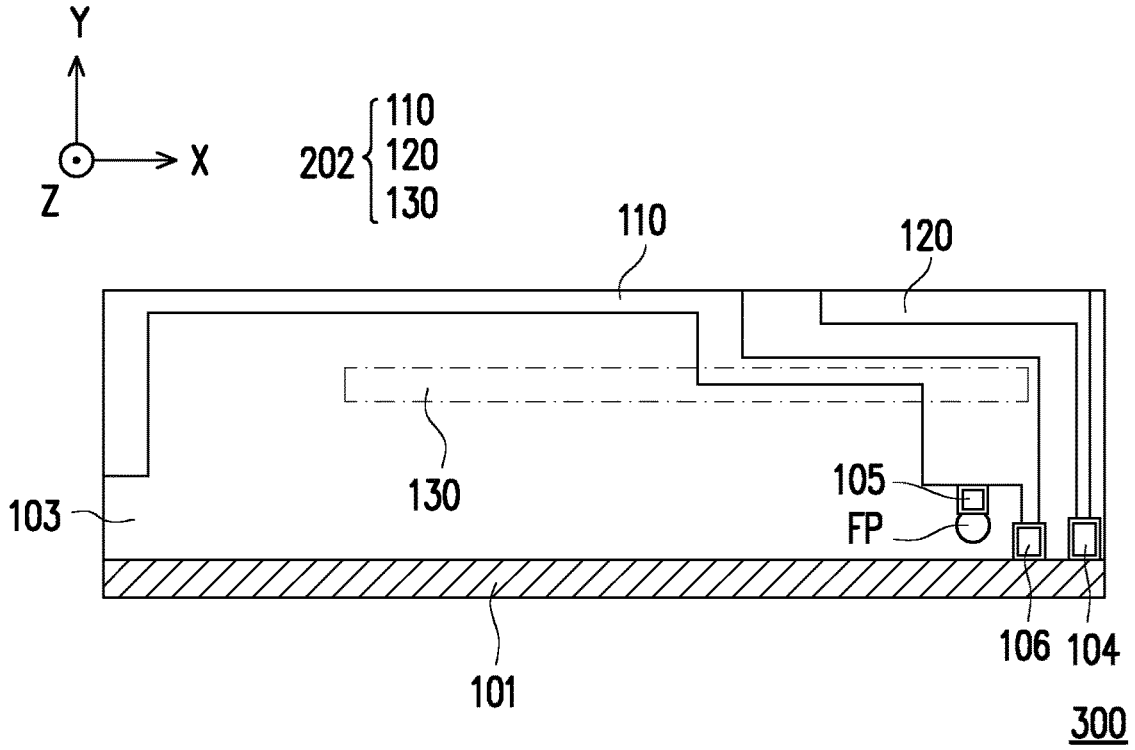
FIG. 3 is a schematic top view of a multi-band antenna according to still another embodiment of the disclosure.

FIG. 3 is a schematic top view of a multi-band antenna 300 according to still another embodiment of the disclosure. The difference between the multi-band antenna 300 of FIG. 3 and the multi-band antenna 200 of FIG. 2 is that the third radiation portion 130 of FIG. 3 and the first radiation portion 110 overlap each other more in the Z direction, thereby further improving the coupling efficiency between the third radiation portion 130 and the first radiation portion 110. Furthermore, the multi-band antenna 300 of FIG. 3 also includes a matching component 105 and a matching component 106. As shown in FIG. 3, the first end of the first radiation portion 110 may be coupled to the feeding point FP through the matching component 105, and the first end of the first radiation portion 110 is also coupled to the ground plane 101 through the matching component 106. The matching component 105 and the matching component 106 may be used to adjust the impedance matching of the antenna element 202 in the first band (the band generated through the first radiation portion 110), such that the antenna element 202 reaches the bandwidth set by the first band.

Similarly, since the first end of the second radiation portion 120 is coupled to the ground plane 101 through the matching component 104, the matching component 104 may be used to adjust the impedance matching of the antenna element 202 in the second band (the band generated through the second radiation portion 120), such that the antenna element 202 reaches the bandwidth set by the second band. In this embodiment, the matching component 104 and the matching component 105 can be capacitors, and the matching component 106 may be an inductor. Therefore, by providing matching components 104, 105, 106 at and around the feeding point FP, the antenna element 202 is capable of reaching a predetermined bandwidth, thereby effectively improving the overall performance of the antenna element 202.

In summary, in the embodiments of the disclosure, the antenna elements of the multi-band antenna may be respectively operable in three communication bands through the first radiation portion, the second radiation portion, and the third radiation portion. By maintaining an electrical floating state between the first radiation portion and the second radiation portion, and maintaining the electrical floating state between the first radiation portion and the third radiation portion, it is possible to avoid the situation that the low-frequency band and the high-frequency band of the antenna elements interfere with each other. Since there is no need to take the band interference into consideration, the coupling distance between the first radiation portion and the second radiation portion can be shortened as much as possible to save the antenna layout area. In addition, by disposing the third radiation portion and the first radiation portion respectively on two opposite surfaces of the substrate of the multi-band antenna, the layout space of the antenna element can be saved effectively. Therefore, in the limited antenna layout space of the communication device, the first radiation portion, the second radiation portion and the third radiation portion of the preset size can be configured, such that the operating band range of the antenna element can be maximized, thereby improving the performance of the antenna elements.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A multi-band antenna, comprising:

a ground plane; and an antenna element, comprising:

a first radiation portion, a first end of the first radiation portion coupled to a feeding point, and a second end of the first radiation portion is a first open end; and a second radiation portion, a first end of the second radiation portion coupled to the ground plane, and a second end of the second radiation portion being a second open end, wherein the second radiation portion is not electrically connected to the first radiation portion, and a coupling distance exists between the second radiation portion and the first radiation portion, wherein the antenna element operates in a first band through the first radiation portion, and operates in a second band through the second radiation portion, and a frequency of the first band is lower than a frequency of the second band, wherein the first end of the first radiation portion is coupled to the feeding point through a first matching component, and the first end of the first radiation portion is coupled to the ground plane through a second matching component, and the first matching component and the second matching component are configured to adjust impedance matching of the antenna element in the first band.

2. The multi-band antenna according to claim 1, wherein the first band comprises a band between 704 MHz and 960 MHz, and the second band comprises a band between 1710 MHz and 2170 MHz.

3. The multi-band antenna according to claim 1, wherein the first radiation portion sequentially comprises a first segment, a second segment, a third segment, a fourth segment and a fifth segment connected in series from the feeding point to the first open end, a longitudinal direction of the second segment and a longitudinal direction of the fourth segment are both parallel to a first direction, a longitudinal direction of the third segment and a longitudinal direction of the fifth segment are both parallel to a second direction, and the first direction is perpendicular to the second direction.

4. The multi-band antenna according to claim 3, wherein the second radiation portion comprises a sixth segment and a seventh segment connected in series with each other, a longitudinal direction of the sixth segment is parallel to a longitudinal direction of the third segment, a longitudinal direction of the seventh segment is parallel to a longitudinal direction of the second segment.

5. The multi-band antenna according to claim 1, wherein the multi-band antenna has a substrate, and the multi-band antenna further comprising:

a third radiation portion, not electrically connected to the first radiation portion, and the third radiation portion and the first radiation portion respectively disposed on two opposite surfaces of the substrate, wherein the antenna element is operated in a third band through the third radiation portion, and a frequency of the third band of the third radiation portion is higher than a frequency of the second band of the second radiation portion.

6. The multi-band antenna according to claim 5, wherein the third band comprises a band between 2.3 GHz and 2.7 GHz.

7. The multi-band antenna according to claim 5, wherein an orthogonal projection of the first radiation portion on the substrate and an orthogonal projection of the third radiation portion on the substrate form an overlapping region, the overlapping region has a first area, the orthogonal projection of the third radiation portion on the substrate has a second area, the first area is smaller than the second area, and the feeding point is adjacent to the overlapping region.

8. The multi-band antenna according to claim 5, wherein a short side of the substrate has a first width, and a first distance exists between the third radiation portion and the ground plane, and the first distance is greater than or equal to half of the first width.

9. The multi-band antenna according to claim 1, wherein the first end of the second radiation portion is coupled to the ground plane through a third matching component, the third matching component is configured to adjust impedance matching of the antenna element in the second band.

10. The multi-band antenna according to claim 1, wherein the first matching component is a capacitor and the second matching component is an inductor.

11. The multi-band antenna according to claim 9, wherein the third matching component is a capacitor.

* * * * *